US006896249B1

(12) United States Patent
Ferrara

(10) Patent No.: US 6,896,249 B1
(45) Date of Patent: May 24, 2005

(54) MULTIPLE JAW MACHINING VISE

(75) Inventor: William Ferrara, Sunrise, FL (US)

(73) Assignee: Vise Jaws Inc., Deerfield Beach, FL (US)

( * ) Notice: Subject to any disclaimer, the term of this patent is extended or adjusted under 35 U.S.C. 154(b) by 20 days.

(21) Appl. No.: 10/725,128

(22) Filed: Dec. 1, 2003

(51) Int. Cl.[7] ..... B25B 1/00
(52) U.S. Cl. ..... 269/154; 269/45; 269/138
(58) Field of Search ..... 269/154, 43, 138, 269/244, 271, 137, 41, 229

(56) References Cited

U.S. PATENT DOCUMENTS 4,825,513 A * 5/1989 Verespej ..... 24/135 N
5,098,073 A 3/1992 Lenz
5,595,378 A * 1/1997 Martinsson et al. ..... 269/210
5,649,694 A 7/1997 Buck
5,735,513 A * 4/1998 Toffolon ..... 269/43
5,893,551 A 4/1999 Cousins et al.
6,062,553 A * 5/2000 Strehl ..... 269/43
6,105,948 A * 8/2000 Young ..... 269/43
6,502,809 B1 * 1/2003 Gionta ..... 269/43
6,659,439 B1 * 12/2003 Baumgartner et al. ..... 269/43

* cited by examiner

*Primary Examiner*—Lee D. Wilson
(74) *Attorney, Agent, or Firm*—Alvin S. Blum

(57) ABSTRACT

A vise for holding more than one work piece on the support surface of a machine tool has a base for mounting on the support surface. More than one stationary jaws are fastened to the base. More than one movable jaws are slidably mounted on the base to move toward and away from the stationary jaws to securely hold at least one work piece between each pair of a stationary and a movable jaw. Movement of the each movable jaw is provided by a first mechanism that closes on the work piece snugly to accommodate minor variations in work piece dimensions. A second movement mechanism moves all of the movable jaws with great force including a spring bias to tightly clamp all of the work pieces at once with enough force to enable machine operations on the work pieces with no chance of their moving from the machining operations.

11 Claims, 13 Drawing Sheets

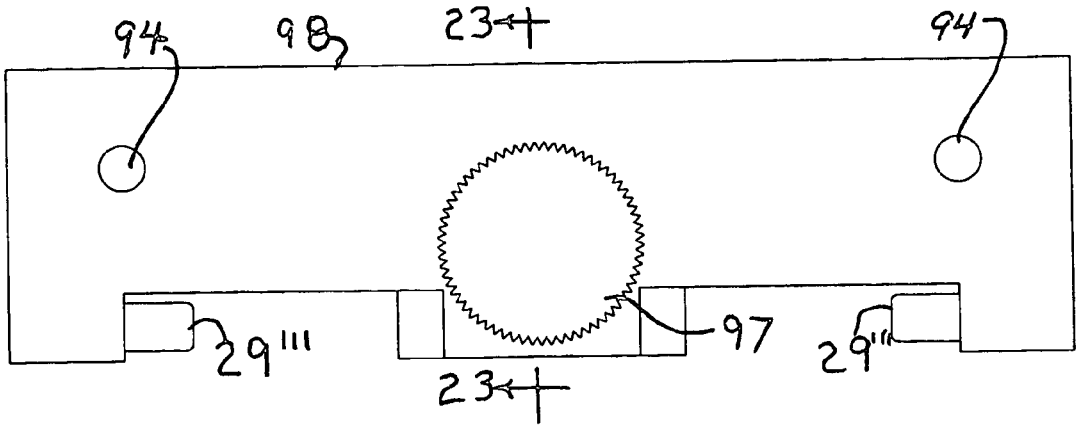
FIG. 22
FIG. 24
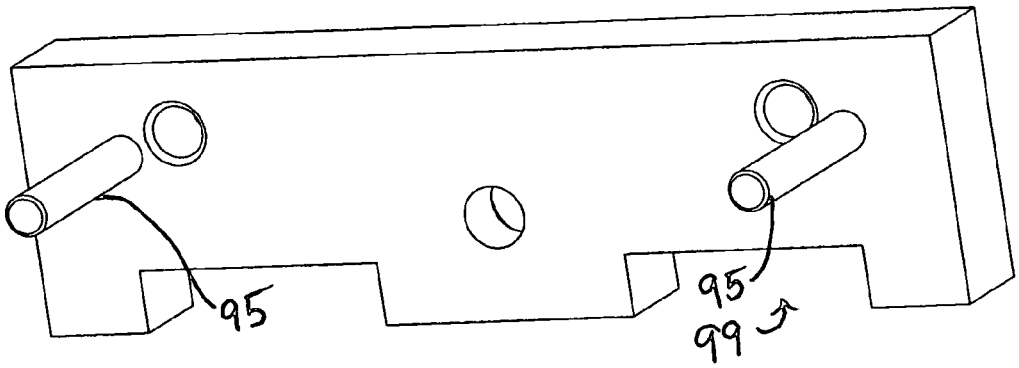
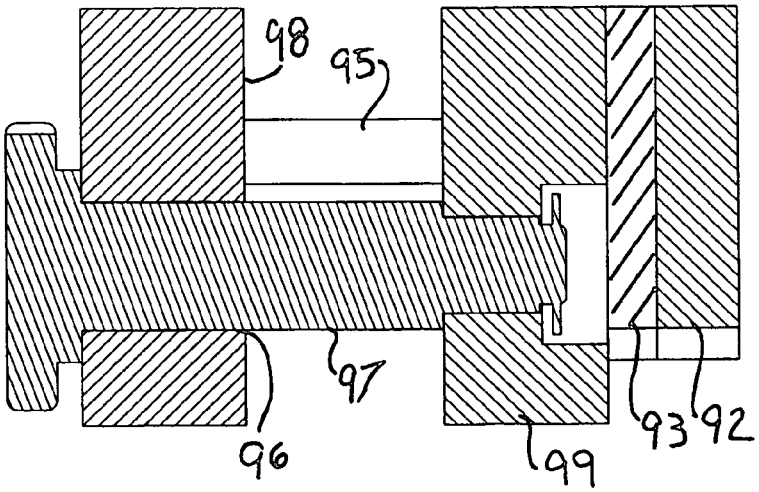
FIG. 23

MULTIPLE JAW MACHINING VISE

This invention relates to work holding devices for securely mounting work pieces on a machine tool, and more particularly to such devices for machining multiple pieces at the same time.

BACKGROUND OF THE INVENTION

When machining a work piece, the piece must be securely mounted in a vise on the machine so that the forces of machining do not move the piece and destroy precision. The mounting of the piece in the vise may consume a considerable portion of the labor cost of machining. U.S. Pat. No. 5,893,551 issued Apr. 13, 1999 to Cousins et al.; U.S. Pat. No. 5,649,694 issued Jul. 22, 1997 to Buck; and U.S. Pat. No 5,098,073 issued Mar. 24, 1992 to Lenz teach machine vises for simultaneously holding two pieces with a single stationary common jaw and two movable jaws that move toward the stationary jaw from opposite directions. Their inventions are limited to holding only two pieces at a time.

SUMMARY OF THE INVENTION

It is accordingly an object of the invention to provide a machine vise for holding a plurality of work pieces in a common vise. It is another object that a separate stationary and movable jaw be provided for each work piece. It is another object that each piece be subjected to substantially the same clamping pressure by the use of a single pressure clamp mechanism. It is another object that the vise be adapted for placement side by side with identical vises with no spacing there between for enhanced machine utility.

The vise has a base that may be secured to a support surface of a machine. A plurality of stationary jaws may be removably affixed to the base at a plurality of selectable positions. A plurality of movable jaws are slidably supported on the base for translatory motion along the long axis of the base. They are positionable at a plurality of selectable positions relative to the stationary jaws. An elongate cam plate is slidably supported in a base channel. The cam plate has a plurality of upstanding projections adapted for engaging the movable jaw assemblies and thereby determining the position of the jaw on the long axis. By selection of particular projections, the movable jaw may be spaced apart from a mating stationary jaw as desired. A cam engagement member is interposed between the movable jaw and the projections. A first adjustment screw moves the jaw relative to the cam engagement member to snugly engage the piece to adjust for minor dimension differences between work pieces. When the pieces have all been snugly engaged by their jaws, a cam lever mechanism advances the cam plate a very short distance along the long axis. This forces the projections to apply pressure to the cam engagement members and the movable jaws. The stationary jaw and the piece applied thereto and the movable jaw resist the movement. This causes a spring member interposed between each movable jaw and the cam plate to compress. Thousands of pounds of pressure are thus applied to each piece by the compressed spring member. Movement of the cam lever thus applies substantially uniform pressure to all of the pieces simultaneously. And opposite lever motion releases the compressive force on all of the pieces. When many work pieces must be mounted for machining, and then removed after machining, this may constitute a major portion of the machining effort. Mounting a batch of pieces at once enables the job to be speeded up, thus greatly reducing costs of machining.

These and other objects, features, and advantages of the invention will become more apparent when the detailed description is studied in conjunction with the drawings in which like elements are designated by like reference characters in the various drawing figures.

BRIEF DESCRIPTION OF THE DRAWINGS

FIG. 22 is a front elevation view of the movable jaw assembly of another embodiment of the invention.

FIG. 23 is a sectional view taken through line 23—23 of FIG. 22.

FIG. 24 is a perspective view of the coarse adjustment jaw plate of the embodiment of FIG. 22.

DETAILED DESCRIPTION OF PREFERRED EMBODIMENTS

Figure 1:
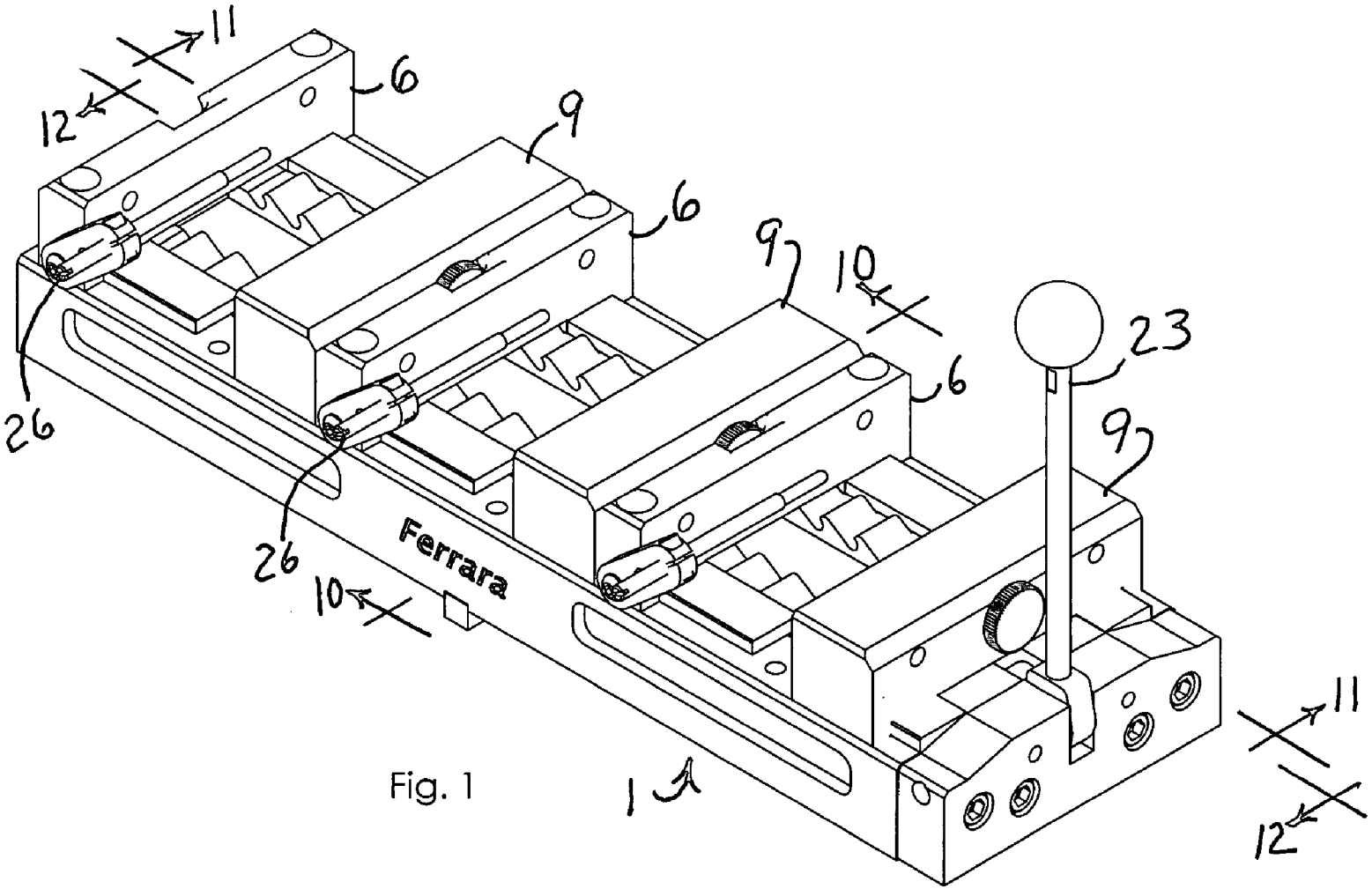
FIG. 1 is a perspective view of the vise.
Figure 2:
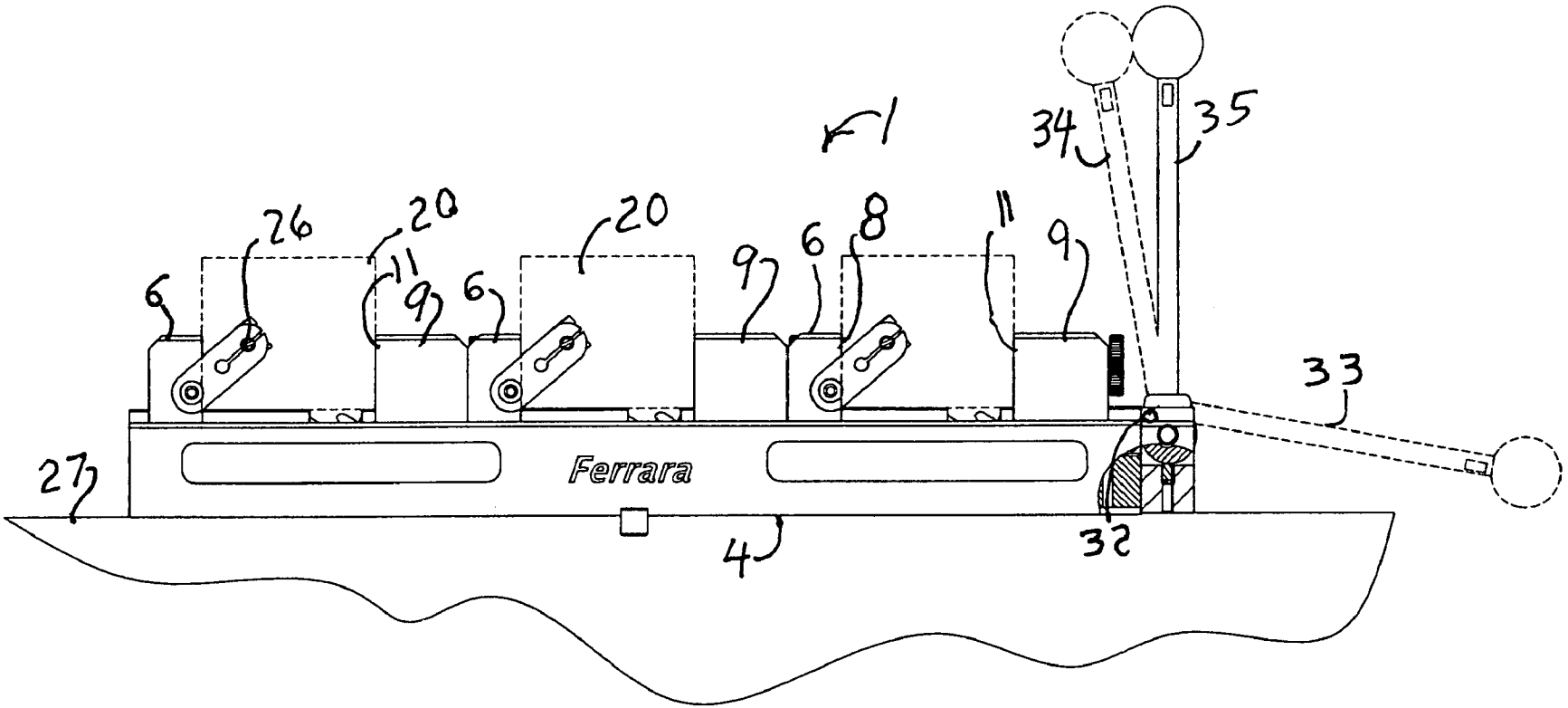
FIG. 2 is a side view of the vise.
Figure 3:
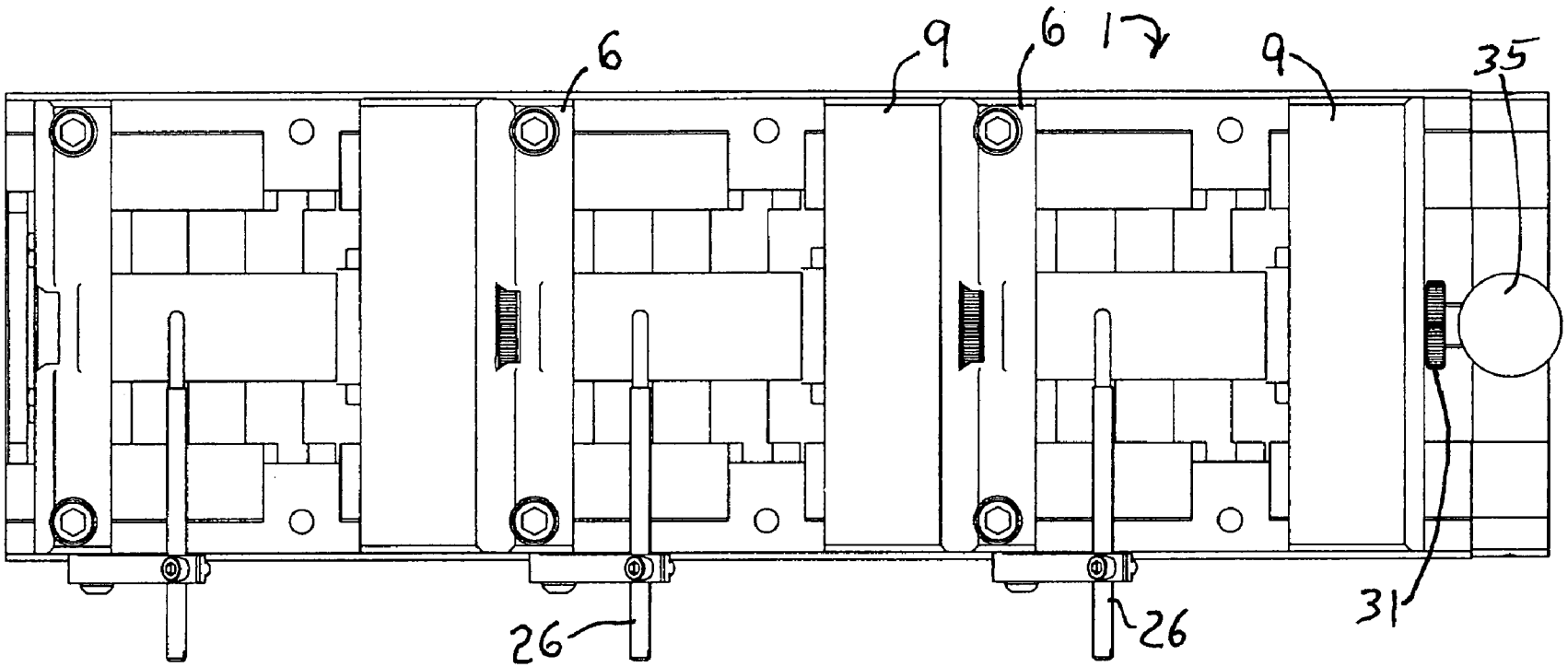
FIG. 3 is a top view of the vise.
Figure 4:
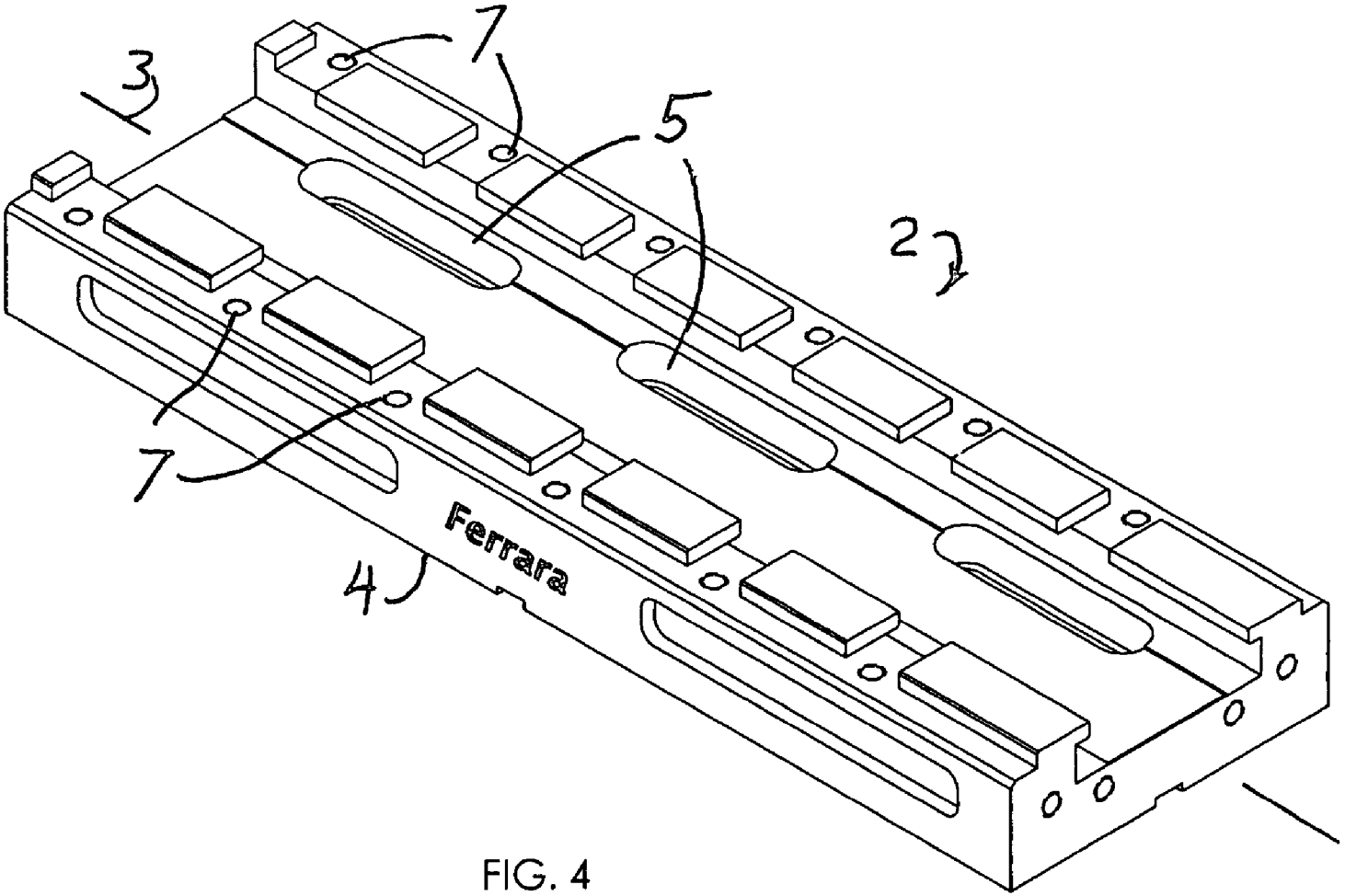
FIG. 4 is a perspective view of the base.
Figure 7:
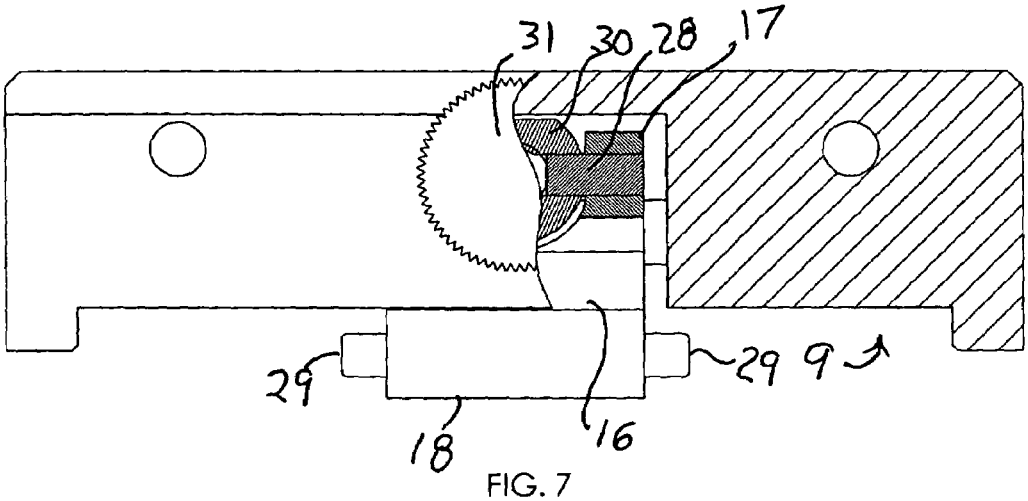
FIG. 7 is a front elevation view of the movable jaw assembly partially broken away.
Figure 5:
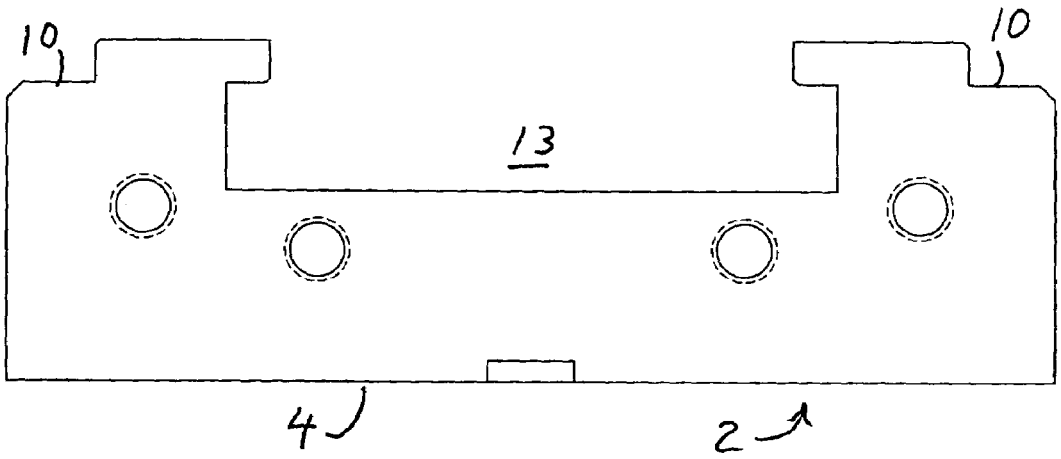
FIG. 5 is an end view of the base
Figure 6:
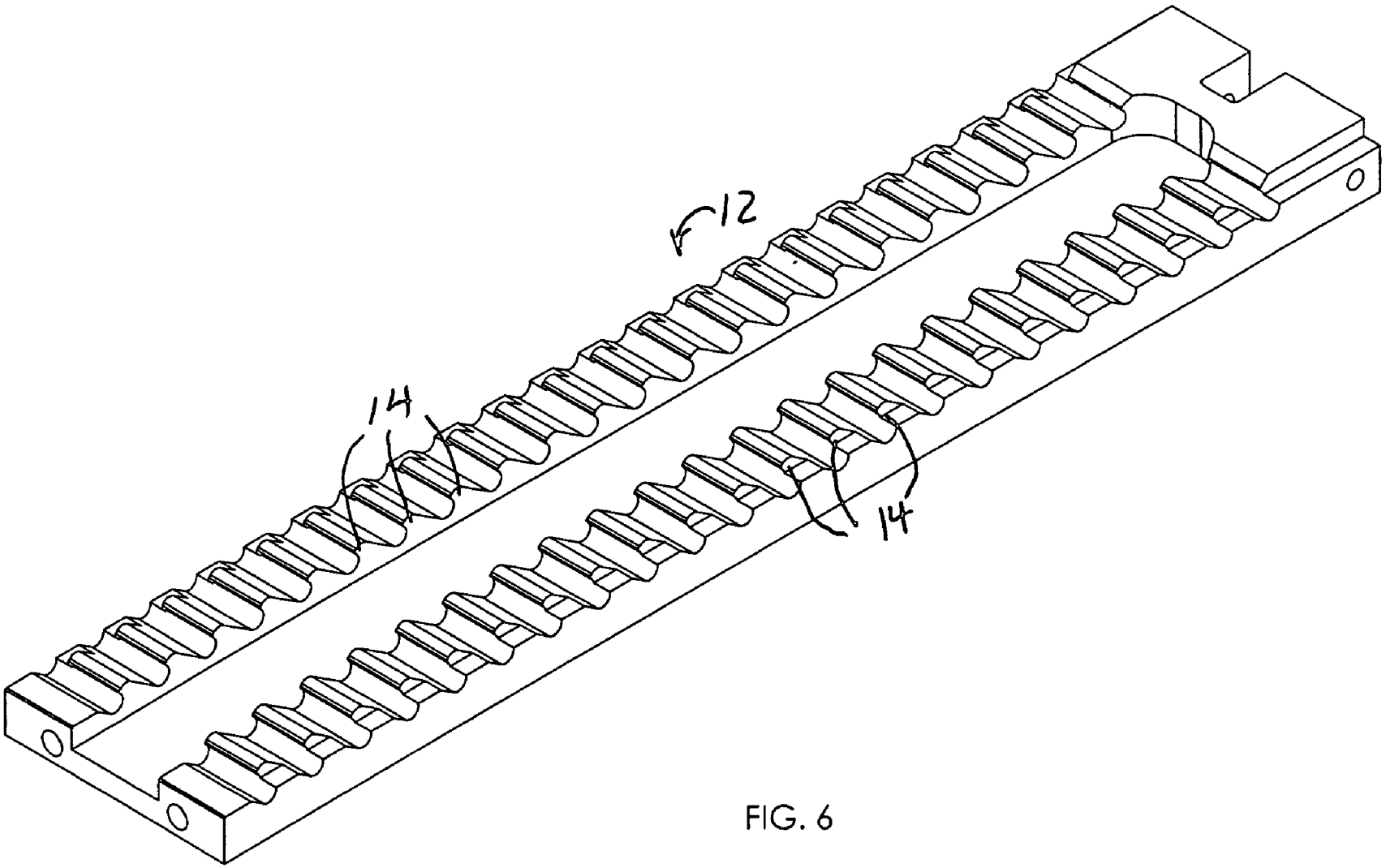
FIG. 6 is a perspective view of the cam plate.
Figure 10:
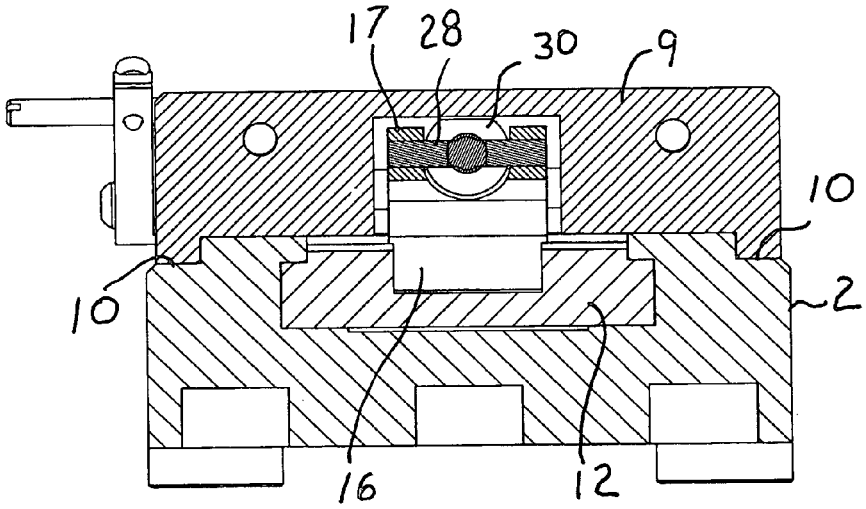
FIG. 10 is a sectional view of the vise taken through line 10—10 of FIG. 1.
Figure 8:
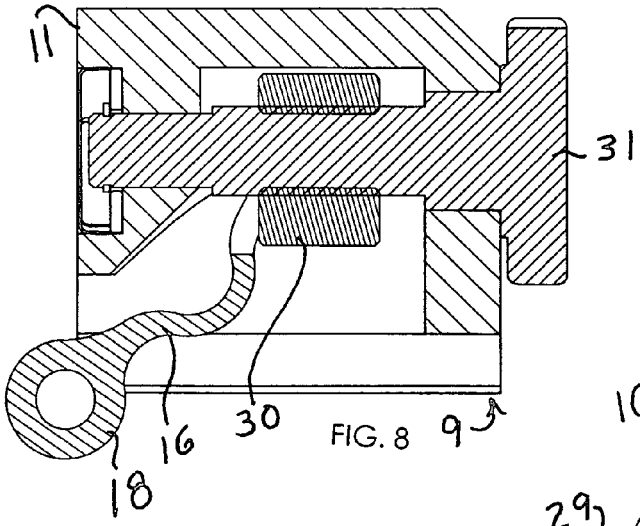
FIG. 8 is a sectional view of the movable jaw assembly taken through line 8—8 of FIG. 7.
Figure 9:
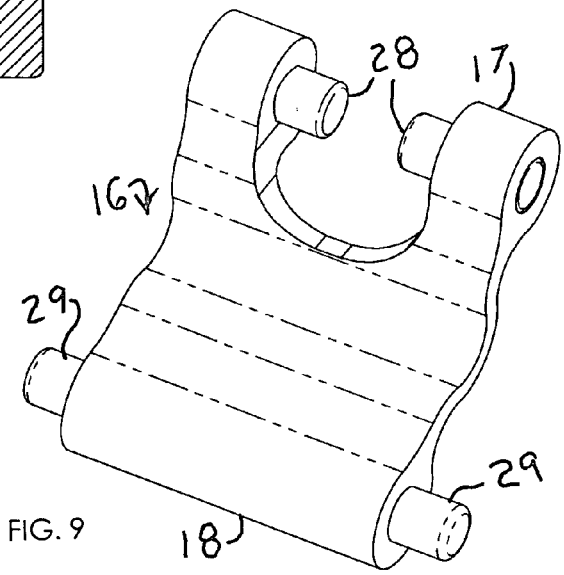
FIG. 9 is a perspective view of the spring member.
Figure 13:
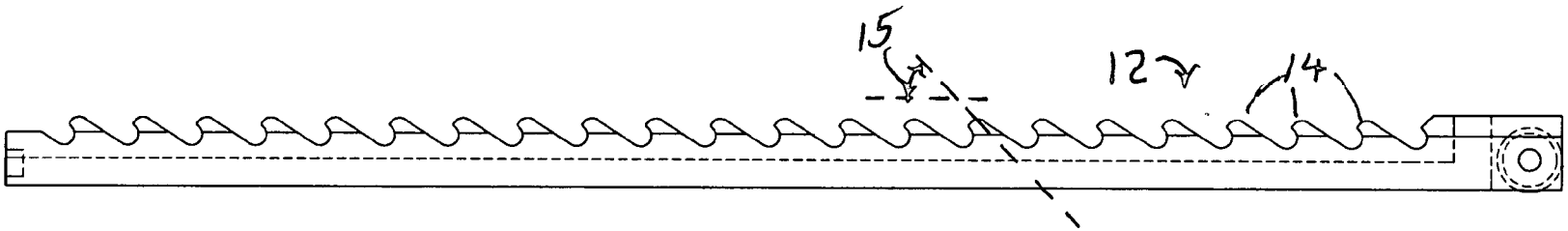
FIG. 13 is a side elevation view of the cam plate.
Figure 11:
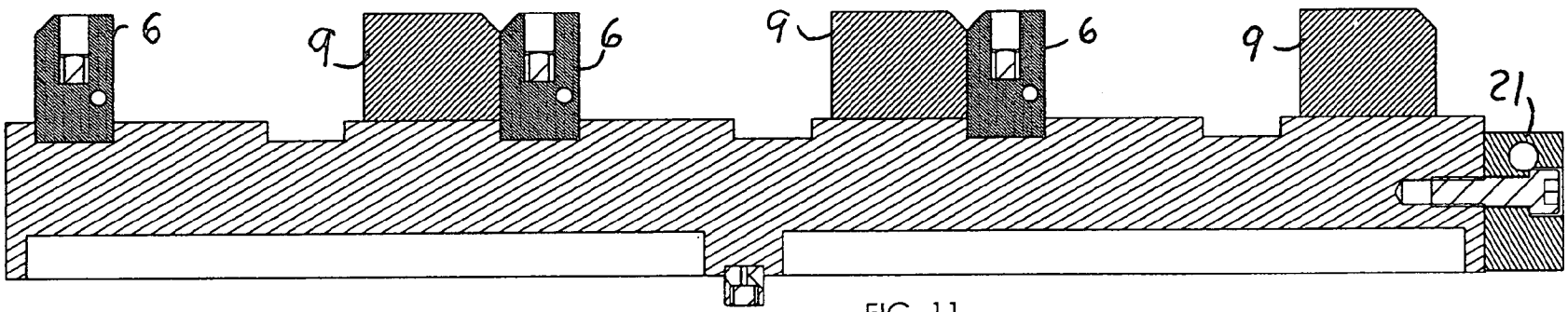
FIG. 11 is a sectional view of the vise taken through line 11—11 of FIG. 1.
Figure 12:
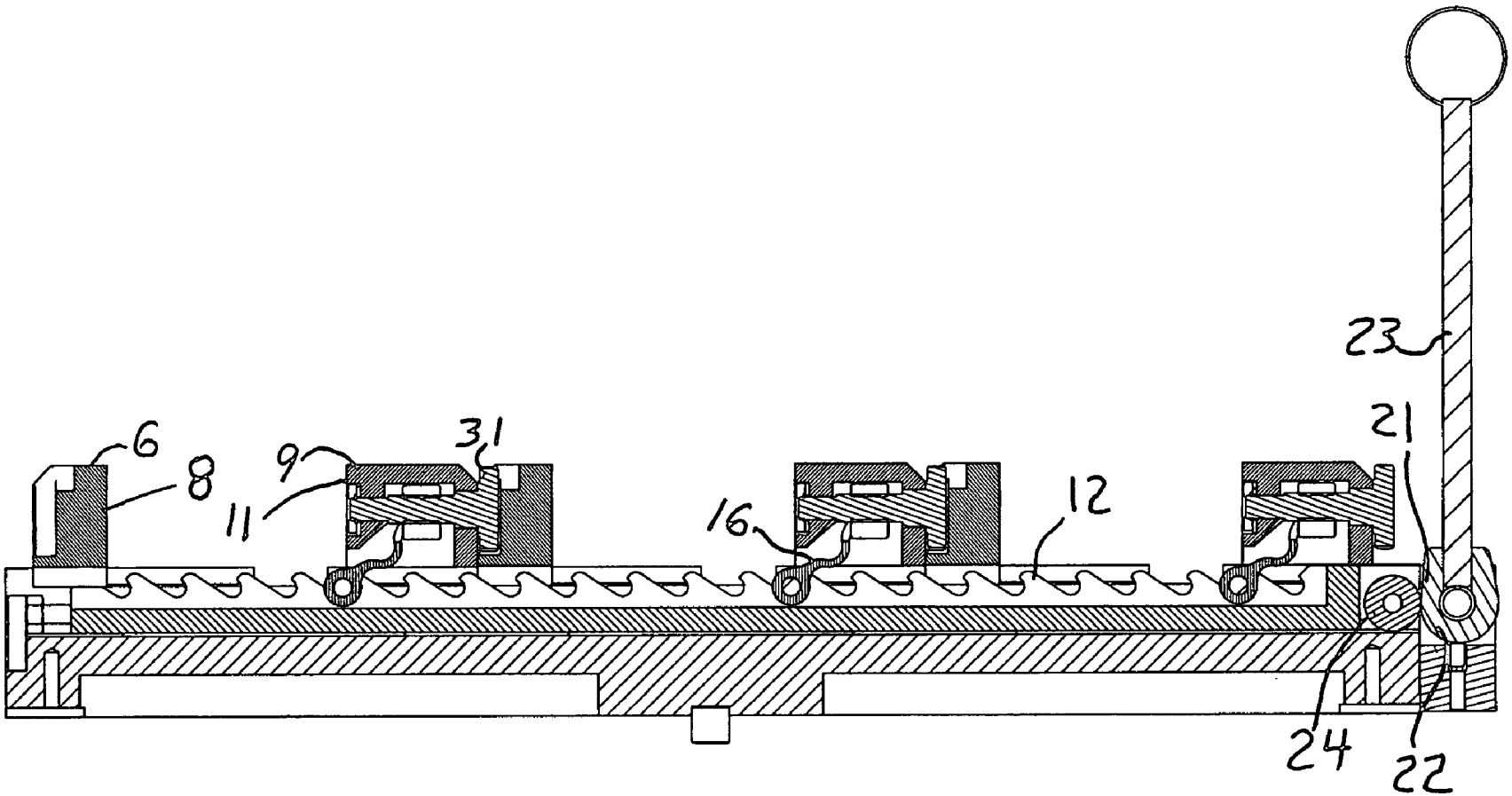
FIG. 12 is a sectional view of the vise taken through line 12—12 of FIG. 1.
Figure 16:
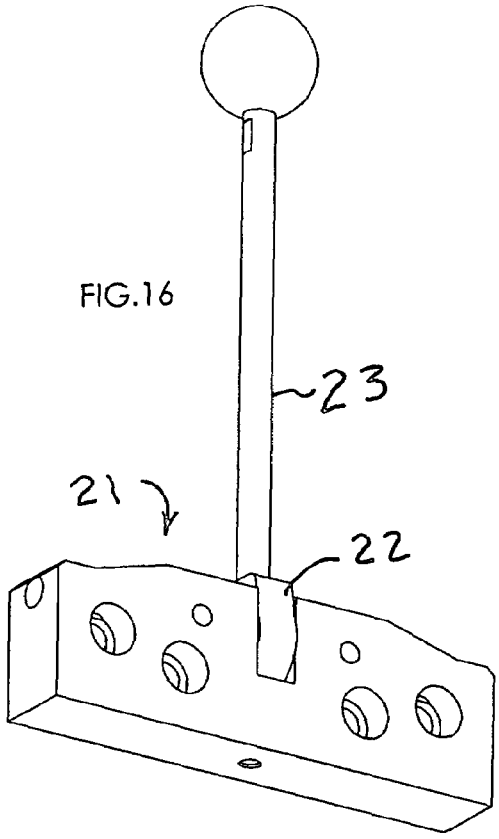
FIG. 16 is a perspective view of the tightening rack assembly.
Figure 15:
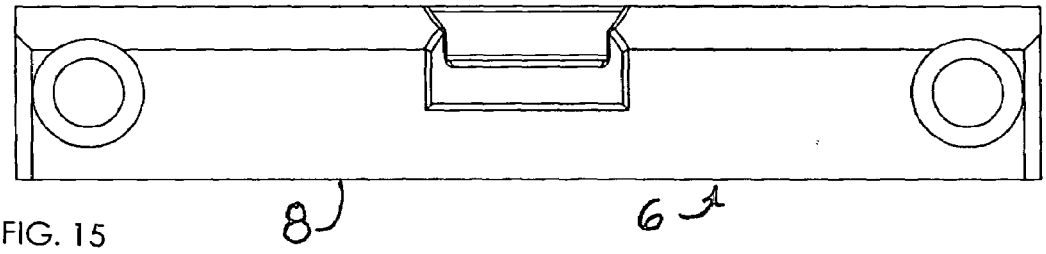
FIG. 15 is a top view of the stationary jaw.
Figure 14:
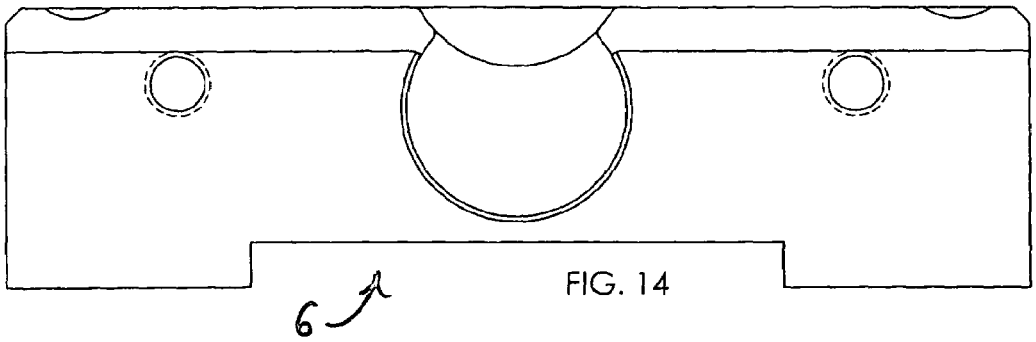
FIG. 14 is a front elevation view of the stationary jaw.

Referring now to the drawing FIGS. 1–16, a vise 1 of the invention is adapted to hold a plurality of work pieces 20 (shown in phantom) that are to be mounted securely together on the work surface 27 of a machine tool. An elongate base 2 has a long axis 3, a planar bottom surface 4 for contact with the support surface, and a plurality of bolt-receiving through apertures 5 for bolting the base to the support surface. A plurality of stationary jaws 6 can be securely bolted to the base at selected positions through threaded holes 7 with the jaw faces 8 transverse to the long axis 3 to accommodate the size of the work pieces.

A plurality of movable jaw assemblies 9 are slidably mounted on ways 10 in the base for translatory motion along the long axis 3, with their jaw faces 11 transverse to the long axis. A cam plate 12 is slidably mounted in channel 13 in the base for translatory motion along the long axis. A plurality of projections 14 is upstanding at a non-orthogonal angle 15 from the cam plate. A spring member 16 has a first end 17 affixed by dowels 28 to the jaw assembly and provided with dowels 29 at a second end 18 adapted for engaging projections 14 selected to establish a gross position of the jaw assembly along the long axis.

A coarse adjustment means 19 in each jaw assembly moves the jaw face toward the stationary jaw for snug contact with the work piece there between. This adjustment means includes a threaded cam nut 30 that receives the dowels 28 and threaded cam screw 31 to move the assembly relative to the projections as it is rotated. The threads of the coarse adjustment means are covered to protect them from cutting debris such as chips and cutting fluid.

A cam plate movement mechanism 21 includes a cam follower 24 pivotally mounted on the cam plate. A cam 22 is pivotally mounted on the base, and a cam lever 23 rotates the cam and advances the cam plate a very slight amount as the lever 23 is turned down to position 33 from the snug position 35. As the movable jaws are all forced against the work pieces, and they in turn are forced against the immovable stationary jaws, the spring members 16 flex under the force. This applies a very high and substantially uniform force of as much as thousands of pounds in the jaws holding the work pieces so that they will not move when subjected to machining forces. The angle 15 of the projections 14 provides a force vector pushing the jaw assembly against the base for enhanced stability. An adjustable stop element 26 may be mounted on each stationary jaw to adjustably determine lateral position of the work piece. The cam plate movement mechanism may be provided by a hydraulic or pneumatic mechanism as well (not shown).

After the pieces have been machined, they may be removed and replaced with new pieces with very little effort. The cam lever is turned up to position 35, and each screw 31 is turned enough to release the finished part. As each new piece is mounted the screw 31 is tightened. When all the new pieces have been mounted, the lever is lowered to securely hold all of the pieces simultaneously, and machining is begun.

Alternatively, a third position 34 of the cam lever 23, shown in phantom, is established by detent 32. This moves the cam plate and the movable jaws away from the work pieces a slight amount, so that the work pieces may be removed and replaced without adjustment of the cam screw 31 each time.

Figure 18:
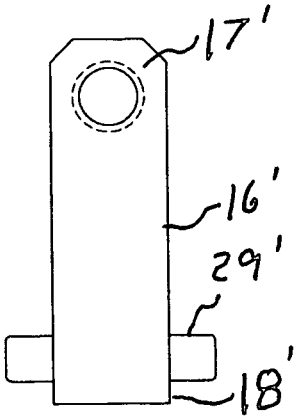
FIG. 18 is a front elevation view of the projection engaging member of the embodiment of FIG. 17.
Figure 19:
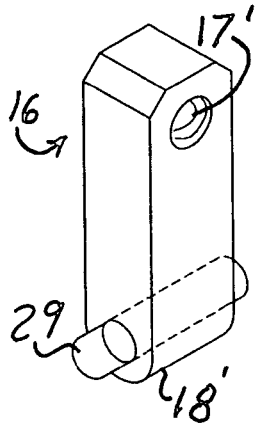
FIG. 19 is a perspective view of the projection engaging member of FIG. 18.
Figure 17:
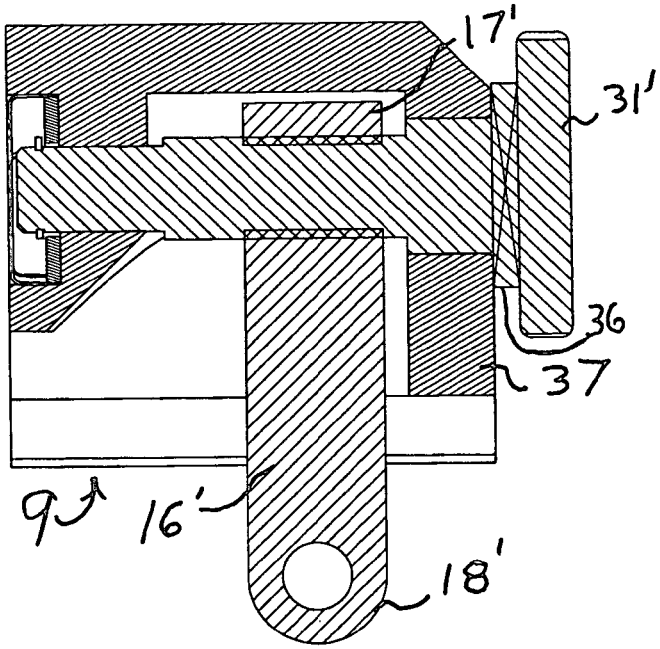
FIG. 17 is a sectional view as in FIG. 8 of the movable jaw assembly of another embodiment of the invention.

Referring now to FIGS. 17–19, another embodiment of the movable jaw assembly 9' of the invention has a rigid projection engaging member 16' with a first threaded end 17', and a second end 18' for receiving a dowel 29' for engaging the projections of the cam plate. A coarse adjustment cam screw 31' threadedly engages the member 16' so that movement of the cam plate forces it toward the stationary jaw. A resilient washer 36 is forced against the body 37 of the jaw assembly by movement of the cam plate, thereby governing the force applied to the jaw face. The resilient washer may be a belleville washer, a polyurethane washer, or other resilient member well known in the art requiring great force to compress.

Figure 20:
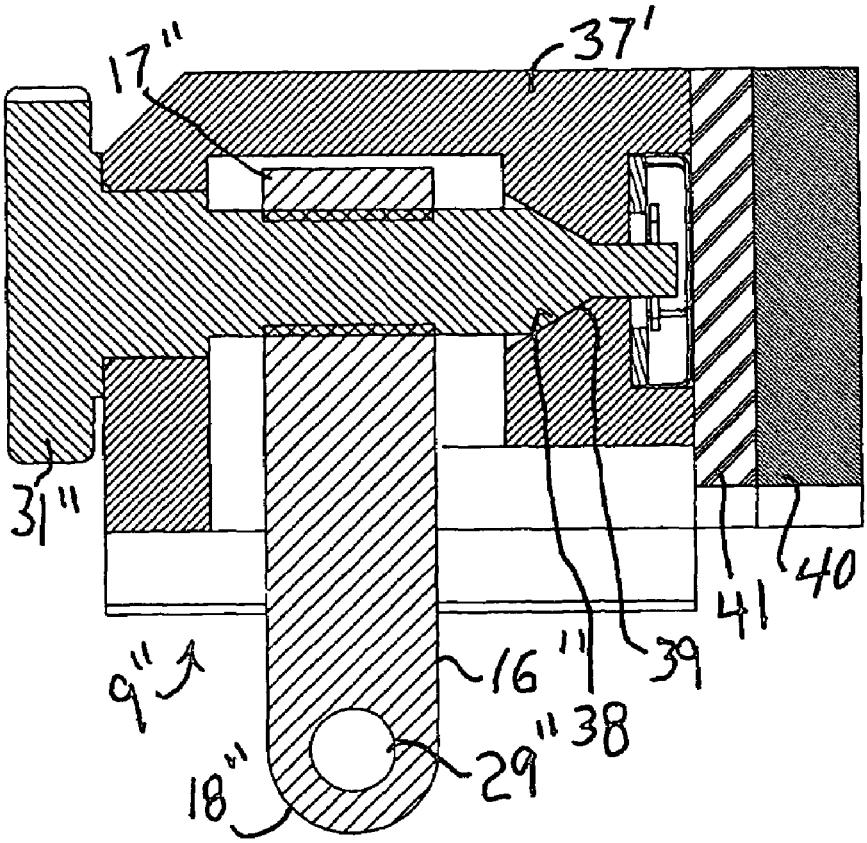
FIG. 20 is a sectional view as in FIG. 17 of another embodiment of the invention.
Figure 21:
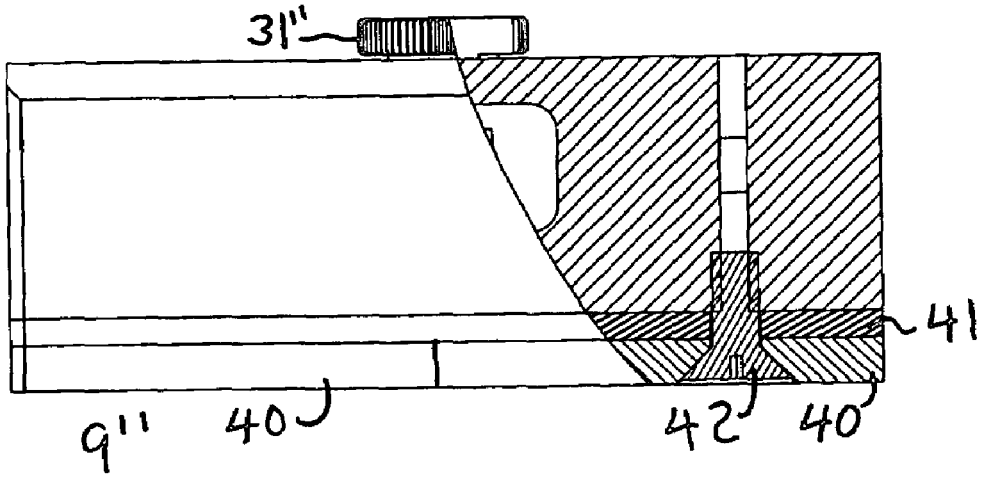
FIG. 21 is a top view of the embodiment of FIG. 20.

Referring now to FIGS. 20,21, another embodiment of the movable jaw assembly 9" of the invention has a rigid projection engaging member 16" with a first threaded end 17", and a second end 18" for receiving a dowel 29" for engaging the projections of the cam plate. A coarse adjustment cam screw 31" threadedly engages the member 16" so that movement of the cam plate forces it toward the stationary jaw. Adjustment screw 31" has a tapered portion 38 that engages a tapered seat 39 in the body 37' of the assembly to force the body toward the stationary jaw. A pair of machineable jaw faces 40 are removably attached to the body 37' by bolts 42. A pair of spring plates 41 that may be wave springs or rubber springs, for example are interposed between the body and the jaw faces so that relatively uniform high pressure is applied to the work pieces when the cam plate is advanced. The plate type springs ensure that more of the work piece will be contacted by the jaw face for enhanced holding.

Referring now to FIGS. 22–24, another embodiment of the movable jaw assembly 9''' of the invention has a body portion 98 provided with dowels 29''' to engage the projections of the cam plate. A threaded through hole 96 in body portion 98 receives coarse adjustment screw 97. Screw 97 butts up against, and is captive in, coarse adjustment jaw plate 99 so that rotation of the screw advances or retracts the plate 99 to adjust the gap between jaws to snugly engage a work piece. Pins 95 affixed to plate 99 pass through apertures 94 in body 98 to maintain attitude of plate 99. Resilient plate 93 interposed between the jaw plate 99 and jaw face plate 92 provides the pressure control when the cam plate is advanced as described supra.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A vise for holding a plurality of work pieces onto a support surface, the vise comprising:

a) a base with a long axis, and a bottom surface for contact with the support surface;

b) securing means for bolting the base to the support surface;

c) a plurality of stationary jaws with means for removably affixing to the base at selectable positions along the long axis with jaw faces transverse to the long axis;

d) a plurality of movable jaw assemblies slidably mounted in the base for translatory motion along the long axis with jaw faces transverse to the long axis;

e) a first adjustment means in each jaw assembly for coarse adjustment of the position of the assembly along the long axis for snugly engaging the work piece between the stationary and movable jaw faces; and f) a pressure mechanism for forcing all of the movable jaw assemblies in a common direction along the long axis toward their corresponding stationary jaws for thereby applying substantially uniform high pressure to all of the movable jaws simultaneously.

2. A vise for holding a plurality of work pieces onto a support surface, the vise comprising:

a) a base with a long axis, and a planar bottom surface for contact with the support surface;

b) a plurality of bolt receiving apertures orthogonal to, and passing through, the bottom surface for bolting the base to the support surface;

c) a plurality of stationary jaws with means for removably affixing to the base at selectable positions along the long axis with jaw faces transverse to the long axis;

d) a plurality of movable jaw assemblies slidably mounted in a channel of the base for translatory motion along the long axis with jaw faces transverse to the long axis;

e) a cam plate mounted in a channel in the base for slidable movement along the long axis;

f) a plurality of projections extending along the long axis upstanding from the cam plate;

g) a projection engaging member connected to the jaw assembly at a first end and provided with means at a second end for engaging selected ones of the projections to determine a gross position of the jaw assembly;

h) a coarse adjustment means in each assembly for coarse adjustment of the position of the assembly along the long axis for snugly engaging the work piece between stationary and movable jaw faces; and i) a cam plate movement mechanism for moving the cam plate and all of the movable jaw assemblies engaged thereby in a common direction along the long axis toward their corresponding stationary jaws thereby flexing a spring member interposed between each movable jaw face and the cam plate and applying substantially uniform high pressure to all of the movable jaws simultaneously.

3. The vise according to claim 2 in which the projections extend from the cam plate non-orthogonally, such that the movable jaw assembly is subjected to a force vector pressing the assembly against the channel as well as toward the stationary jaw when the cam plate is advanced by the cam plate movement mechanism.

4. The vise according to claim 2 in which the cam plate movement mechanism comprises a cam pivotally mounted on the base that is rotatable by a lever.

5. The vise according to claim 2 further comprising a stop element mounted on the stationary jaw for adjustably determining a lateral position of the work piece.

6. The vise according to claim 2 in which the cam plate movement mechanism provides three positions of the movable jaw faces, a first position in which the movable jaw faces are spaced away from their corresponding stationary jaw faces, a second position in which the movable jaw faces are closer to the stationary jaw faces so as to hold the work piece snugly with the coarse adjustment means, and a third position in which the movable jaw faces are further advanced toward the stationary faces while the spring member is flexed to apply said uniform high pressure.

7. The vise according to claim 2 in which the spring member is interposed between a body of the jaw assembly and a movable jaw face.

8. The vise according to claim 7 in which the movable jaw face is in two parts to enable two work pieces to be held.

9. The vise according to claim 2 in which the spring member is interposed between a body of the jaw assembly and the cam plate.

10. The vise according to claim 2 in which the coarse adjustment means includes a screw mechanism having threads that are protected from exposure to cutting debris.

11. A vise for holding a plurality of work pieces onto a support surface, the vise comprising:

a) a base with a long axis, and a bottom surface for contact with the support surface;

b) securing means for bolting the base to the support surface;

c) at least three stationary jaws with means for removably affixing to the base at selectable positions along the long axis with jaw faces transverse to the long axis;

d) at least three movable jaw assemblies slidably mounted in the base for translatory motion along the long axis with jaw faces transverse to the long axis;

e) a first adjustment means in each jaw assembly for coarse adjustment of the position of the assembly along the long axis for snugly engaging the work piece between the stationary and movable jaw faces; and f) means for forcing all of the movable jaw assemblies in a common direction along the long axis toward their corresponding stationary jaws for thereby applying substantially uniform high pressure to all of the movable jaws simultaneously.

* * * * *